US009999910B2

(12) United States Patent
Andreatta

(10) Patent No.: US 9,999,910 B2
(45) Date of Patent: Jun. 19, 2018

(54) METHOD FOR CONTROLLING A TWO CONTINUOUS STRANDS ROLLING PLANT

(71) Applicant: Danieli & C. Officine Meccaniche S.P.A., Buttrio (IT)

(72) Inventor: Daniele Andreatta, Borso del Grappa (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 103 days.

(21) Appl. No.: 14/375,907

(22) PCT Filed: Feb. 25, 2013

(86) PCT No.: PCT/IB2013/051498
§ 371 (c)(1),
(2) Date: Jul. 31, 2014

(87) PCT Pub. No.: WO2013/124833
PCT Pub. Date: Aug. 29, 2013

(65) Prior Publication Data

US 2015/0000360 A1 Jan. 1, 2015

(30) Foreign Application Priority Data

Feb. 24, 2012 (IT) ..... MI2012A0277

(51) Int. Cl.
*B21B 37/46* (2006.01)
*B21B 1/16* (2006.01)
(Continued)

(52) U.S. Cl.
CPC ..... *B21B 37/46* (2013.01); *B21B 1/16* (2013.01); *B21B 37/16* (2013.01);
(Continued)

(58) Field of Classification Search
CPC ..... B21B 1/16; B21B 37/46; B21B 2037/002; B21B 2013/006; B21B 1/18;
(Continued)

(56) References Cited

U.S. PATENT DOCUMENTS 4,457,154 A 7/1984 Ohba
5,174,142 A * 12/1992 Pong ..... B21B 1/0815 72/204
(Continued)

FOREIGN PATENT DOCUMENTS

JP S59110412 6/1984
JP S61232001 10/1986
(Continued)

OTHER PUBLICATIONS

Original document JP05104145A is attched.*
Machine translation of JP05104145A is attched.*
Original document JP05104145A is attached.*
Machine translation JP05104145A is attached.*

*Primary Examiner* — Peter DungBa Vo
*Assistant Examiner* — John S Lowe
(74) *Attorney, Agent, or Firm* — Stetina Brunda Garred & Brucker

(57) ABSTRACT

A slit plant comprises a rest bar (14), for regulating the transversal position of an inlet guide to the molder unit (12), a rolling unit for reducing the billet to a rolled section having two sections, a cutting box (13) for separating the two sections into two separate strands, one or more rolling units for rolling the two strands (1, 2), pairs of speed and/or section measurers (20, 21) downstream of the cutting box (13), a shear (15). The method for controlling the plant provides measuring the rolling speeds V1 and V2 of each of the two strands (1, 2) and/or of the respective sections A1 and A2 of the two strands (1, 2) downstream of the cutting box (13) by means of pairs of measurers; detecting the lengths of the two strands (1, 2) and calculating the differ-
(Continued)

ence in length thereof, based on which the plant, in a successive feedback step, is activated to decrease the difference in length between the two strands (1, 2).

11 Claims, 7 Drawing Sheets

(51) Int. Cl.
*B21B 37/16* (2006.01)
*B21B 13/00* (2006.01)
*B21B 37/00* (2006.01)

(52) U.S. Cl.
CPC ... *B21B 2013/006* (2013.01); *B21B 2037/002* (2013.01); *B21B 2275/06* (2013.01)

(58) Field of Classification Search
CPC ... B21B 1/0815; B21B 37/52; B21B 2273/20; B21B 2275/60
See application file for complete search history.

(56) References Cited

U.S. PATENT DOCUMENTS 6,708,077 B2 * 3/2004 Brower ..... B21B 37/005 700/149
2004/0034442 A1 2/2004 Brower et al.
2013/0186157 A1 * 7/2013 Riches ..... B21B 39/02 72/11.2
2015/0000360 A1 * 1/2015 Andreatta ..... B21B 1/16 72/11.1

FOREIGN PATENT DOCUMENTS

JP 05104145 A * 4/1993 ..... B21B 1/0815
JP H05104141 4/1993
JP H09155449 6/1997
JP 2005319495 11/2005

* cited by examiner

METHOD FOR CONTROLLING A TWO CONTINUOUS STRANDS ROLLING PLANT

CROSS REFERENCE TO RELATED APPLICATIONS

The present application claims priority to PCT International Application No. PCT/IB2013/051498 filed on Feb. 25, 2013, which application claims priority to Italian Patent Application No. MI2012A000277 filed Feb. 24, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a method for controlling a two continuous strand or bar production plant by means of slit process, said two continuous strands being obtained in said plant by continuously dividing a single metal billet into two parts along the central longitudinal axis thereof.

STATE OF THE ART

The two strand slit process is used to increase the production of a plant which generates strands and/or bars and it provides that, after the passage of the single initial billet in one or more rolling stands or units to achieve a substantially rectangular section, the rolled section is longitudinally divided into two equal parts by means of the passage in channels made in specifically shaped rolling rolls, thus resulting in two parallel moving rolled sections and therefore resulting in two rolling lines. An important limit to the development of the two strand/bar technology is the division of the material into two exactly equal parts, having the same mass, in the moulder unit. There are various methods in the state of the art for dividing the rolled section into one or more parts; an example is described in U.S. Pat. No. 4,193,283. A different but equally effective sequence of rolling passages of the state of the art is indicated in FIG. 1.

In order to improve the process for dividing the rolled section into two parts which are as equal as possible, a rest bar or fixture holder bar is commonly used which, when manually regulated as shown in Patent IT1247429 or power assisted by operator command, regulates the transversal position of the inlet guide to the moulder unit on which it is installed. In both cases mentioned however, there is a need for human control of the two parts into which the material is divided in the cutting box-control which in any event is performed occasionally and not very accurately.

In plants that use the two strand slit, normally strands/bars are generated with identical sections, thus the difference of the mass between the two strands is transformed into a different lengthening thereof in the various rolling passages. Indeed, the rolls of the rolling units have a specific gap, which is predetermined according to the production campaign and is then kept constant, and therefore the difference of the mass in the two strands—the compression being the same in the respective rolling units—involves a different speed for each of them. The two shears which are immediately downstream of the last rolling unit, one for each rolled strand, cut the two strands at various lengths due to the imperfect division of the rolled section in the moulder unit.

The strands are normally cut by the shears at a multiple length of the commercial length, which is usually 6 or 12 meters, then cooled and custom cut. As the bars have different lengths, scrap tailings of variable dimension will remain for all custom cut bars. In the best plants where there is almost continuous control, by operators, of the rest bar upstream of the moulder unit, this results in a difference in length on the cooling plate (72 m plate) which may reach 0.3%; instead, in average plants, there are differences in length on the cooling plate higher to 0.5%.

Hence, there is a will to minimize the scrap, that is the scrap tailings, in the custom cut on the cooling plate by decreasing, upstream, the difference in length of the two strands, i.e. the difference of mass flow, by improving the division of the rolled section into two equal parts.

In plants in which the commercial length cut (e.g. 6 or 12 meters) is directly performed in line immediately outside the rolling mill, the need is even greater to contain the difference in length of the bars to the greatest extent possible. By assuming the same percentage difference in length, on the cooling plate, of the standard process is also kept for bar lengths cut in line at 12 m, since this difference is added to the machine cutting error, products will be obtained which are not compatible with the market requirements. Hence, there is the will to minimize the differences in length of the strands or of the bars directly cut in line to commercial measurements to prevent them from being out-of-measurement.

Certain documents of the state of the art describe control methods for discontinuous multi-strand rolling mills which are not useful in solving the aforesaid problems in two continuous strand production plants obtained in said plants starting with a single metal billet. For example, document U.S. Pat. No. 4,457,154 describes a method for controlling a parallel rolling plant of two lines of billets, each billet having a head and a tail, with the object to make the mass flow of the billets constant through the various rolling stands, in particular when one of the two billets is not present in a double rolling channel rolling stand (e.g. when the head of a billet enters or the tail of a billet leaves a first rolling line while the other billet is still on the second rolling line within the same rolling stand). This is obtained due to a control method comprising the steps of monitoring the head and tail ends of each billet; detecting when the head end or tail end enters or leaves one of the rolling stands; changing the speed ratios on the rolling stands arranged upstream and downstream of the rolling stand being observed. However, in this type of plant, the billets or strands do not originate from a single billet divided longitudinally into two parts in the same plant. In this type of plant, the billets are rolled one after the other and simultaneously on two parallel lines. As said billets have a head and a tail, problems due to the presence or lack of one of the two billets in the same rolling stand arise in this type of plant, hence different problems arise than the ones to be resolved in continuous production plants of two strands, obtained by continuously dividing a single billet, where among other things it is not possible for there to only be one strand (after the division of the billet) in a rolling stand precisely because the plant is structured to generate two continuous strands, which are only cut downstream of the entire rolling mill.

SUMMARY OF THE INVENTION

It is the primary object of the present invention to make a process for controlling the division of the rolled section into two parts, which implements countermeasures to minimize the difference in length of the two strands or bars, with consequential reduction of the discards and increase of the production process performance.

A further object of this invention consists in eliminating or at least minimizing the presence of operators required for the regulating activities in a bar production plant with two line slit, i.e. in automating the process of such plants to a greater extent.

These and other objects are achieved by a method for controlling a two continuous strands production plant, said two continuous strands being obtained by dividing a single continuous metal billet into two parts along a central longitudinal axis thereof, said plant being provided with one or more first rolling units for reducing the single billet to a substantially rectangular section, a rest bar having an inlet guide mounted thereon, a moulder unit for starting a deformation of the single billet so as to produce a rolled section consisting of two equally shaped parts joined along said central longitudinal axis, the rest bar being configured to regulate a transversal position of the inlet guide with respect to the moulder unit, one or more second rolling units for deforming the rolled section until achieving an almost complete separation of the two equally shaped parts of the rolled section, a cutting box for completing the longitudinal separation of the two equally shaped parts of the rolled section and producing two separate strands, one or more third rolling units for rolling said two strands, along respective rolling lines, comprising a last rolling unit of said plant consisting of a finishing block comprising two separate rolling sub-units which can be regulated independently from each other, and positioned downstream of said first and second rolling units, one or more pairs of sensors adapted to detect speed and/or section surface parameters of the two strands for calculating the mass flow of the two strands and arranged downstream of the cutting box, a cutting shear arranged downstream of said one or more pairs of sensors and of the last rolling unit, wherein said control method provides a step of measuring said speed and/or section surface parameters of the two strands for calculating the mass flow of the two strands, downstream of the cutting box, by means of one or more pairs of sensors, a step of calculating the mass flow of each of said two strands starting from said speed and/or section surface parameters, and of calculating the difference of mass flow between said two strands, a feedback step on at least one component of the production plant for the purpose of decreasing the difference in length between the two strands based on said difference of mass flow between said two strands.

The invention provides the presence of one or more pairs of speed and/or section dimension sensors arranged along the two rolling lines, downstream of the division point of the single billet into two continuous strands, due to which the difference can be monitored in speed and/or section between the two strands and how much mass flow the two strands differ by can be understood. It is understood that the use of the term strand hereinafter in the description is also meant, for reasons of conciseness, to include the term bar as rolled product. Advantageously, the invention also provides using a fixture holder bar which can be automatically moved by a driven command and having movement accuracy within the range of one micron.

In light of the difference detected between the two strands, countermeasures are implemented, which may be different according to the type of plant to which the control system is applied.

In particular, for classical two strand production plants, which provide custom cutting in cooling plate of bars having equal section, a first embodiment of the method of the invention provides generating a feedback signal on the rest bar following the measuring of the speeds of the two strands with a pair of speed sensors arranged immediately downstream of the last rolling unit: the difference in speed between the two strands, the two strands having practically identical section to each other, corresponds to the difference of mass flow.

Alternatively, a pair of section surface (or section area or simply section) sensors can be used immediately after the cutting box or "slit", where the two strands still have the same speed and hence the difference in section surface corresponds to the difference of mass flow.

A further alternative to the two preceding ones consists in using a pair of speed sensors or detectors and a pair of section surface sensors or detectors, both the pairs being arranged between two of the third rolling units, for the cases when there is more than one third rolling unit downstream of the cutting box.

Any other measurement or combination of measurements is possible which allows the mass flow to be obtained. To remedy the differences of mass flow detected downstream, the control system acts upstream, as mentioned, on the rest bar, which automatically performs, with specific driven command, the micrometric centering of the billet in the moulder unit channels.

A second embodiment of the method of the invention is used in plants in which the commercial length cut is applied directly in line immediately downstream of the rolling mill.

This second embodiment of the method, suitable therefore for those plants in which the primary need is to have identical lengths of strand immediately in line and sections within determined tolerances, even if not perfectly identical to each other, provides a control system comprising a pair of speed sensors or detectors and a pair of section surface sensors or detectors, both pairs positioned immediately downstream of the last rolling unit and upstream of the custom cutting shear, in which the last rolling unit consists of a finishing block comprising two separate rolling sub-units, which allows modifications under load to be made to the number of revolutions and possibly also to the gap of the rolling rolls in an independent manner between the two sub-units. Due to this control system, the difference in speed, i.e. in length, of the two strands can be reduced so that it is less than 0.1% (equivalent for example to 12 mm over 12 m). The difference can not be entirely cancelled because there is an engineering limit given by the errors of the sensors, motors and drives.

For this second type of plants, it is also possible to use the combination of this second embodiment of the method just described above with the first embodiment.

The dependent claims refer to preferred embodiments of the invention.

BRIEF DESCRIPTION OF THE FIGURES

Further features and advantages of the invention will be more apparent in light of the detailed description of preferred, but not exclusive, embodiments of a method for controlling a two strand production plant according to the invention, disclosed by way of a non-limiting example, with the aid of enclosed drawings in which.

The same numbers in the figures correspond to the same elements or components.

DETAILED DESCRIPTION OF PREFERRED EMBODIMENTS OF THE INVENTION

Figure 2:
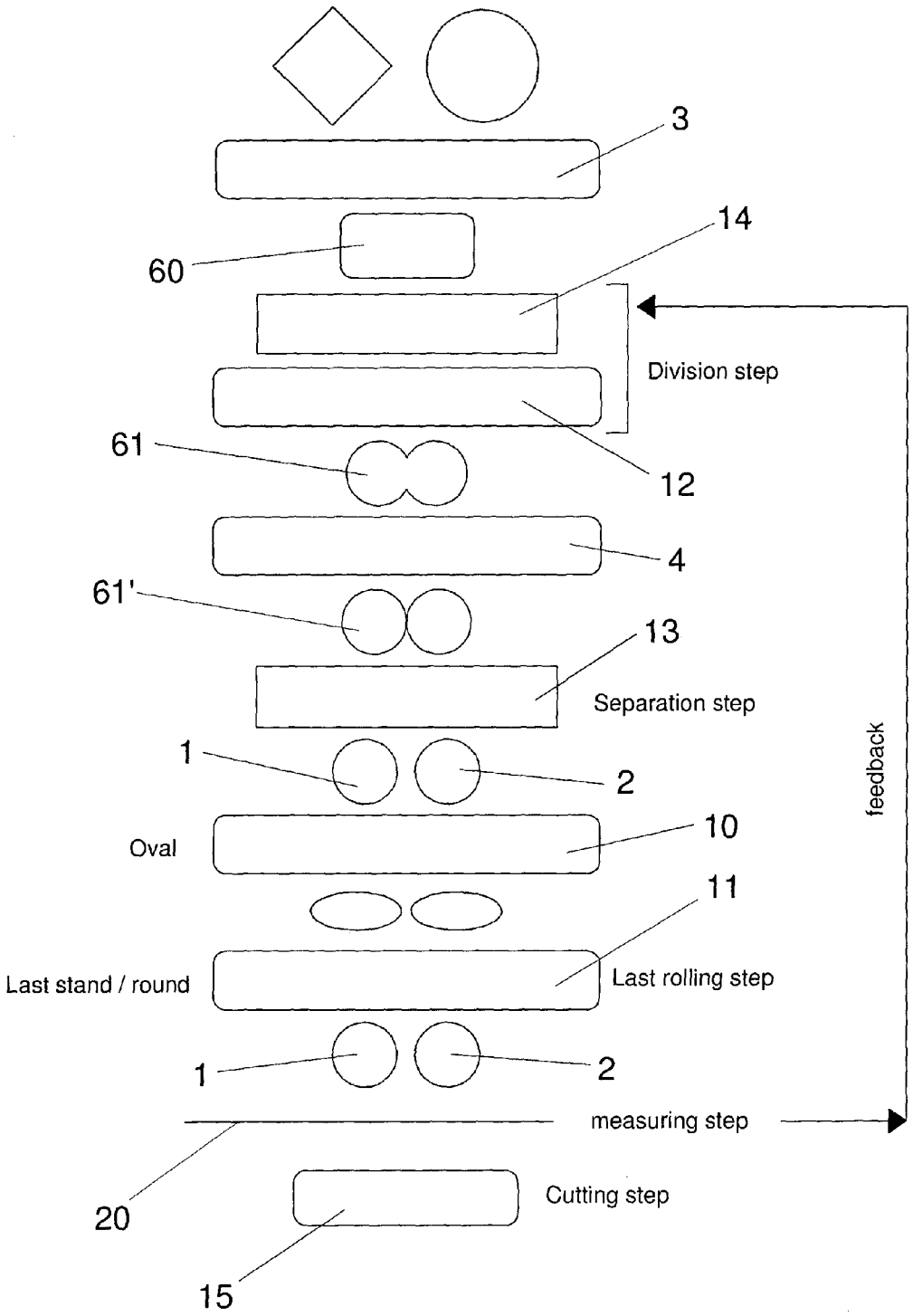
FIG. 2 diagrammatically depicts a sequence of rolling units for a two strand production plant according to a first embodiment of the invention.

With reference to FIG. 2, a sequence is shown of rolling units, per se known, comprising, by way of non-exhaustive example, a rest bar 14, arranged after the rolling stand or unit 3 and immediately upstream of the moulder unit or stand 12. The guide device for guiding the billet 60, called box or rolling guide or inlet guide, installed on the rest bar 14, and the moulder unit 12 together define the deformation step of billet 60, thus defining a central longitudinal axis, so as to produce a rolled section 61 consisting of two equally shaped parts joined along said central longitudinal axis.

The slitting process starts at the rolling stand 3 where the billet profile is generally shaped with a transversal section, for example substantially rectangular, which allows the material to be prepared for the subsequent division.

In the next rolling step, performed by means of one or more rolling units 4, the rolled section 61 is deformed until achieving an almost complete separation of the two equally shaped parts of the rolled section 61, thus obtaining the so-called shaping of the "double round rod" 61' which is then improved and finally cut at the successive step where there is provided a cutting box 13, per se known, to which the step of separating the rolled material into two separate strands 1, 2 corresponds.

Further rolling units with oval and round cross section are arranged downstream of the cutting box 13, sufficient in number to bring the strands to the desired final section, it being normal that the last rolling unit 11 be round in section. A cutting shear 15 is arranged downstream of the last rolling unit 11.

Once separated, the two continuous strands 1 and 2 cross said further rolling units along respective rolling lines 100, 200. The last rolling unit 11 of said plant consists of a finishing block comprising two separate rolling sub-units 11', 11" which may be regulated independently from each other. In a plant of such a type, the control system is provided which implements the method of the invention.

The control system, object of the invention, provides measuring the mass flow on two lines 100, 200 due to one or more pairs of speed and section measurers.

Figure 3:
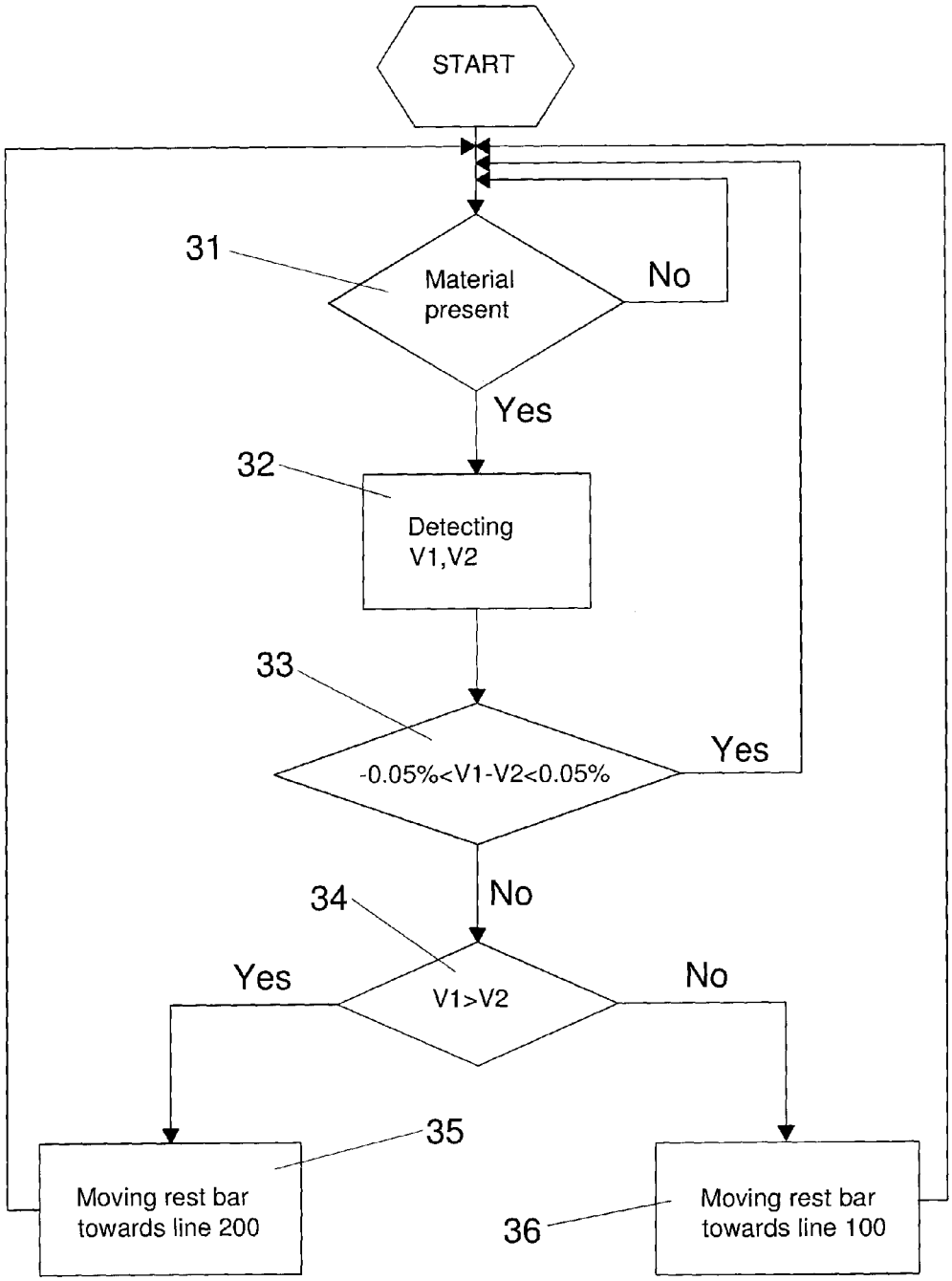
FIG. 3 depicts a flow diagram of a method for controlling the plant in FIG. 2.
Figure 5:
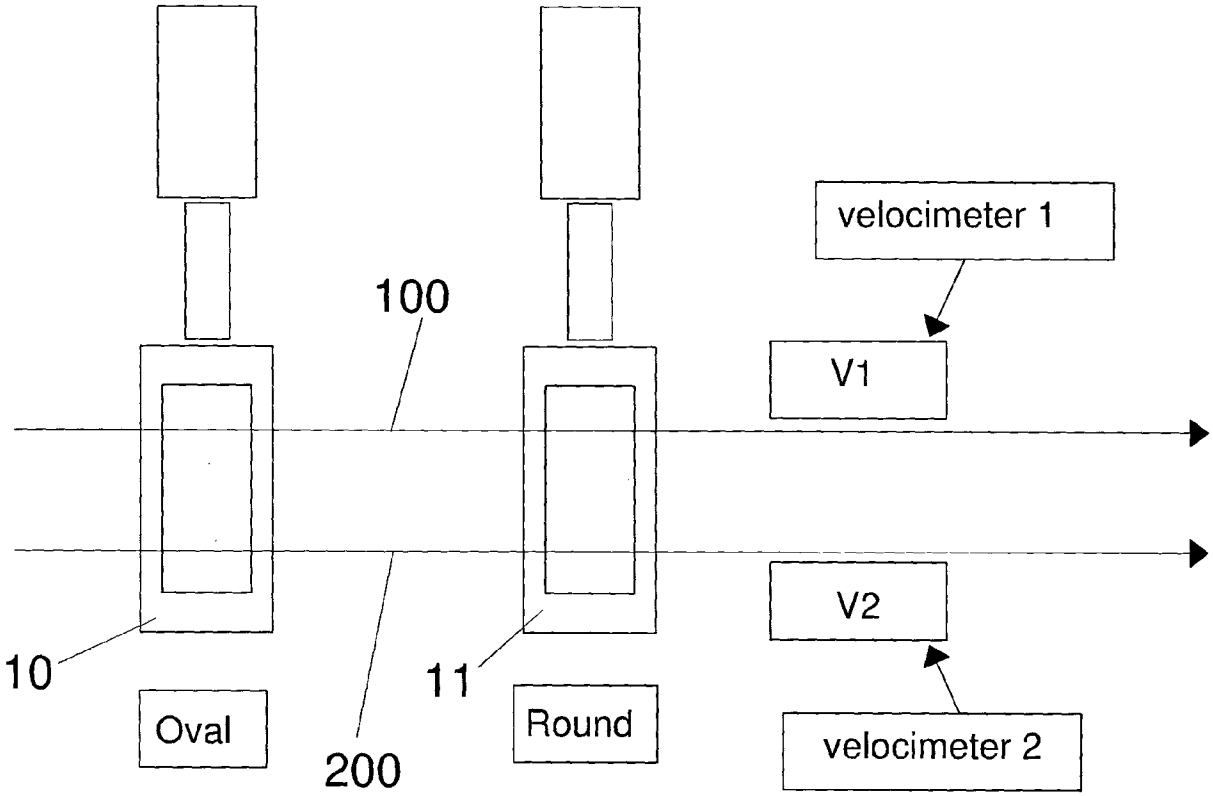
FIG. 5 depicts a detail of the plant in FIG. 2.

For example, as depicted in FIG. 5, a pair of velocimeters can be used, arranged between the last rolling unit 11 and the cutting shear 15. In this case the process object of the invention is used in accordance with a first embodiment, of which FIG. 3 contains the related flow diagram, which provides the production of strands having identical section and the commercial length cut in cooling plate, downstream of shear 15. The control system starts with verifying the presence of the material, that is the strands 1 and 2, below the speed sensors or detectors (velocimeters), indicated with block 31. If there is material, the operation continues by taking the measurements, which in the case depicted, are the speeds V1 and V2, (block 32); if instead, there is no material below the sensors, the cycle resumes. Once the measurement has been taken by the velocimeter positioned between the last rolling unit 11 and shear 15 (block 32), the system performs a query relating to the entity of the difference in the speeds obtained (block 33) and if it is between +0.05% and −0.05%, that is $\Delta V<0.1\%$, the system resumes with a new measurement. If the response at block 33 is negative, the system assesses if the speeds are such that V1>V2 (block 34). If V1>V2, it means that the mass flow on line 100, where strand 1 runs, is greater than the mass flow on line 200, where strand 2 runs, and hence strand 1 is lengthened more than strand 2. Hence the system gives the motor of the rest bar 14 an input so as to perform a micrometric regulation of the position of the rest bar transversally towards line 200 (block 35), thus causing the inlet guide to move transversally with respect to the moulder unit 12, and hence causing the rolling material to move transversally to increase the mass flow of line 200 and consequently decrease the mass flow on line 100. Instead, if the inequality V1>V2 is not true, it means that the opposite circumstance has occurred: the strand 2 of line 200, having a greater mass flow, is lengthened more than the strand 1 of line 100 and hence the system performs a micrometric regulation by moving the rest bar 14 transversally towards line 100 (case of block 36) to increase the inlet mass of the strand 1 on line 100 and decrease the inlet mass of the strand 2 on line 200.

It is understood that the mass flow can be measured with various combinations of speed and section sensors arranged downstream of the cutting box 13 and upstream of the shear 15, and that the process depending thereon is consequently adapted for achieving the same object.

Figure 1:
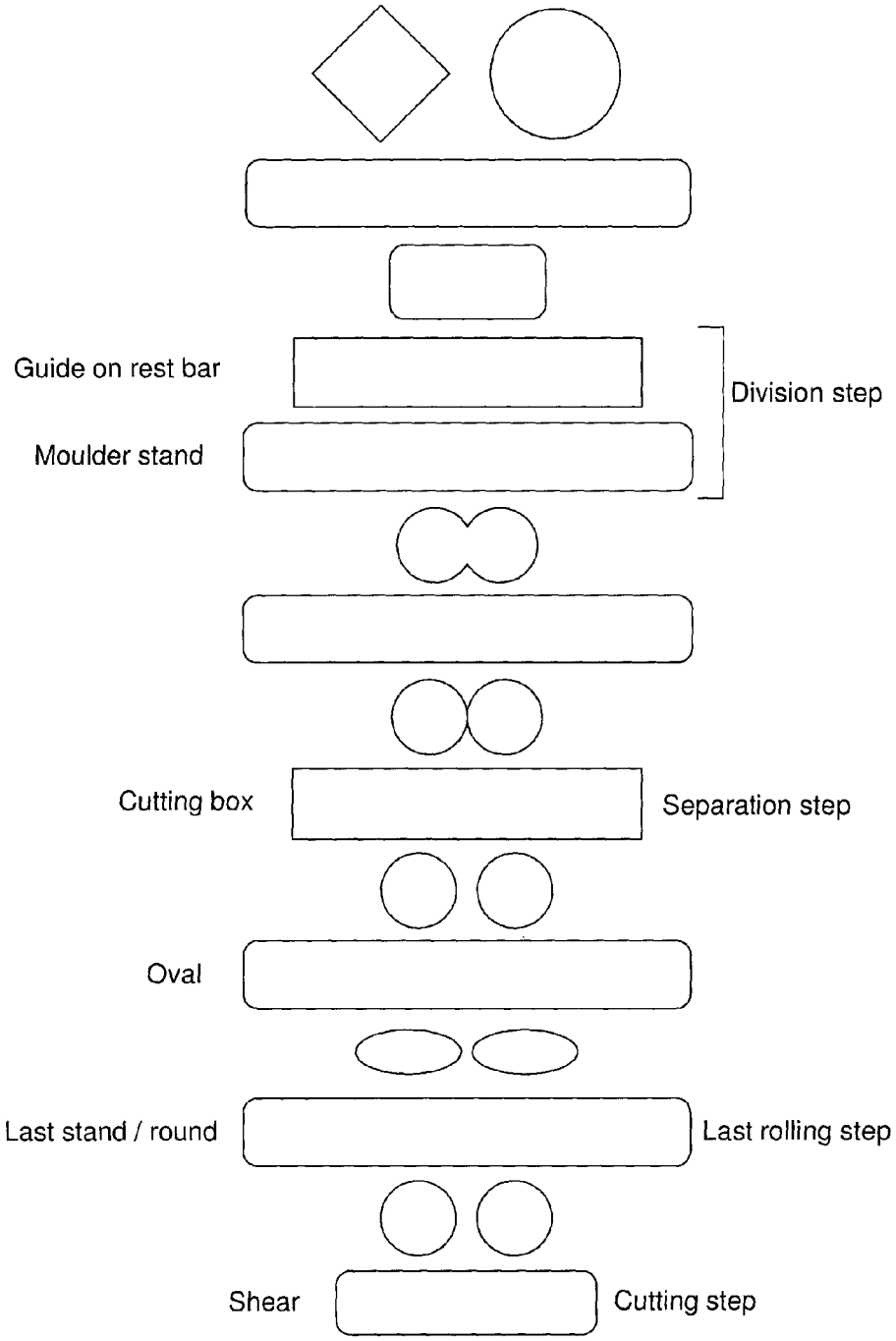
Fig. 1 (Prior Art)
FIG. 1 diagrammatically depicts a sequence of rolling units for a two strand production of the state of the art.
Figure 4:
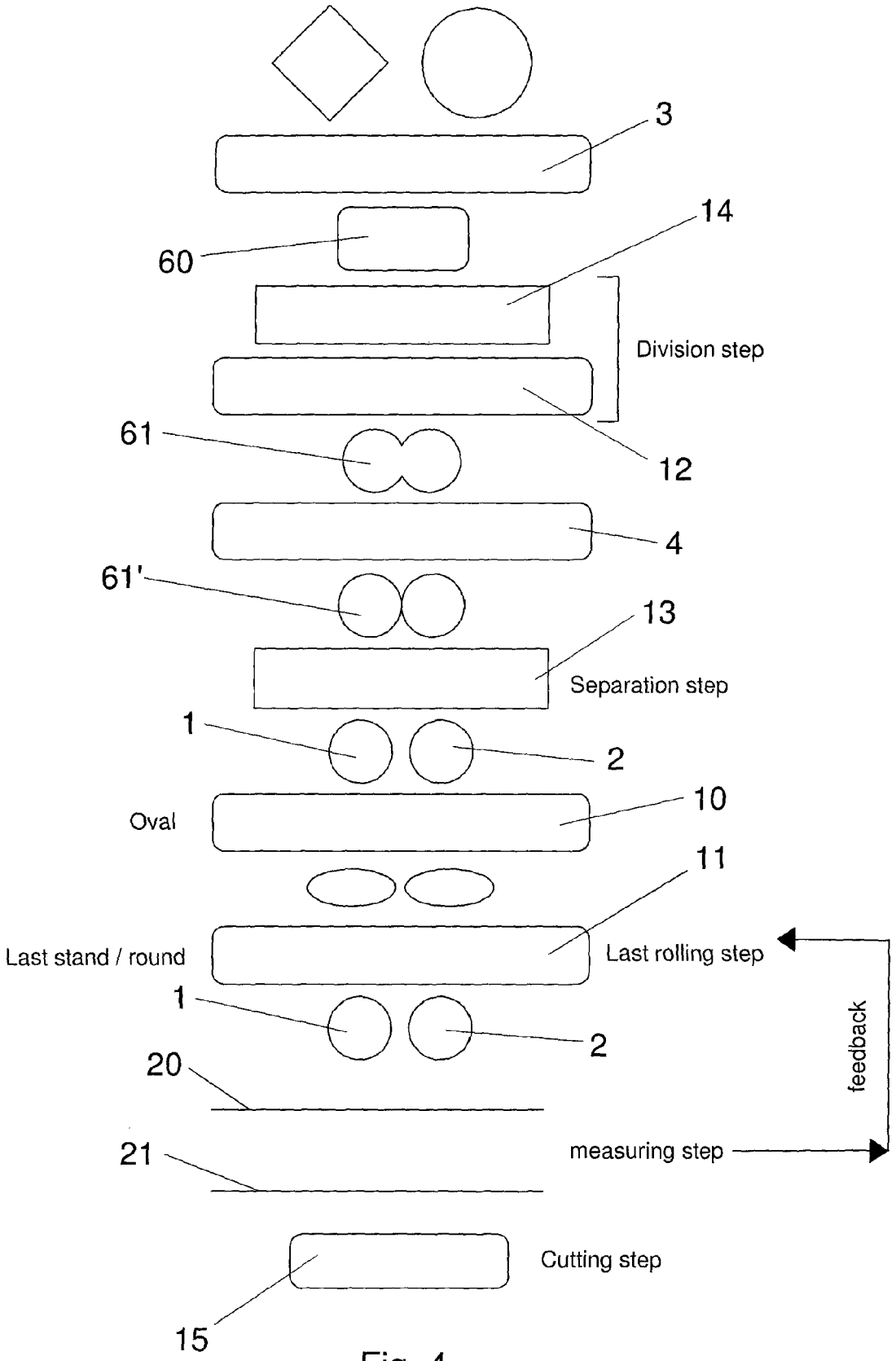
FIG. 4 diagrammatically depicts a sequence of rolling units for a two strand production plant according to a second embodiment of the invention.

The second embodiment of the invention, made by means of the sequence of rolling units shown in FIG. 4 and similar to the one of the rolling plant in FIG. 1, is suitable for plants in which a commercial length cut is applied directly on line immediately outside the rolling mill with the shear 15, and in which it is therefore fundamental to obtain bars in line of the same final length required by the market and with a section which instead may not be identical but must in any event remain within the tolerance required by the market, whereby the cutting lengths between the two strands 1 and 2 are to be made equal.

Figure 6:
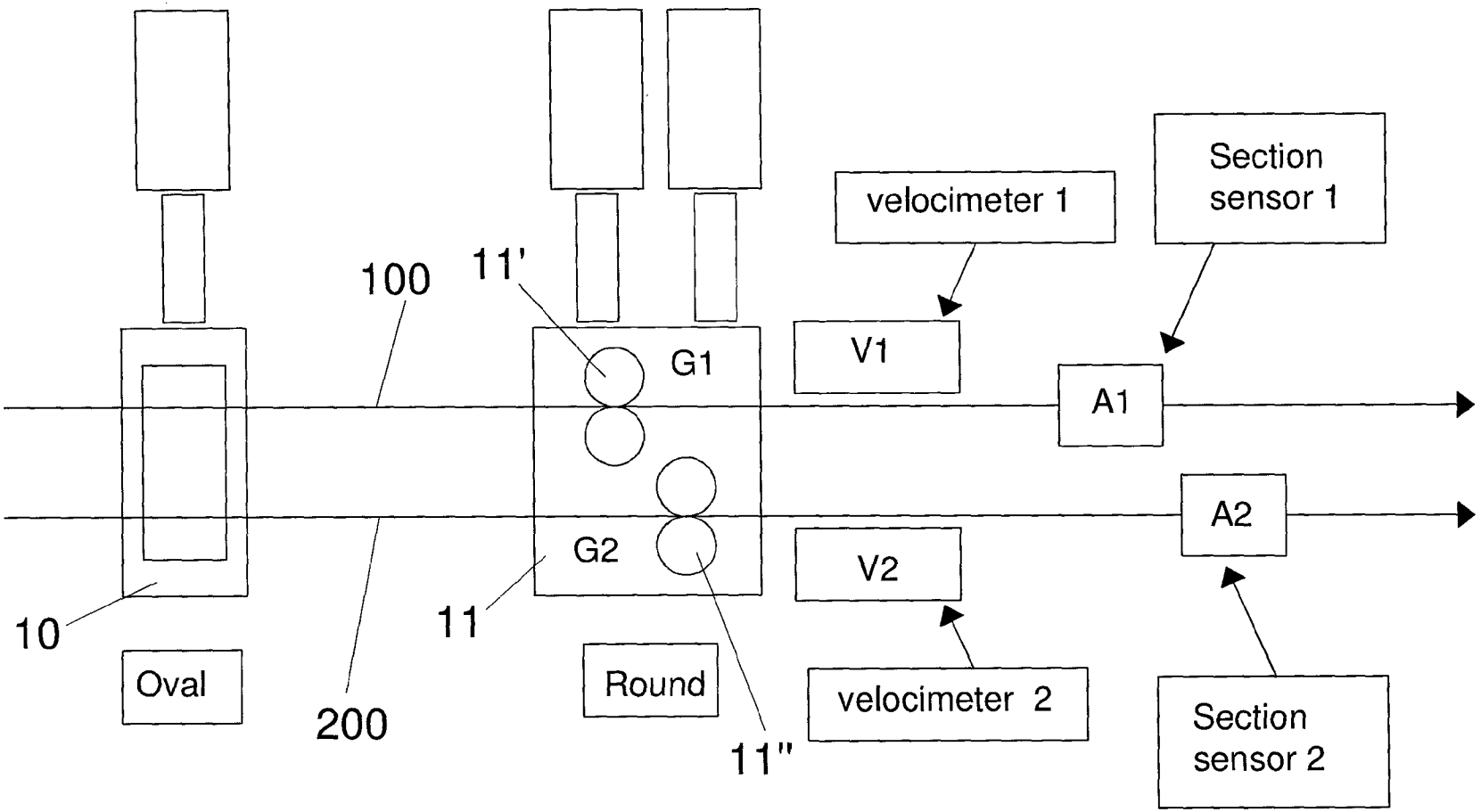
FIG. 6 depicts a detail of the plant in FIG. 4.

In this embodiment of the invention in which a detail is shown in FIG. 6, arranged immediately downstream of the last rolling unit 11 are sensors or detectors of the rolling speed V1, V2 of the strands 1, 2, both arranged before the cutting shear 15.

It is also provided that the last rolling unit 11 for the two strands 1, 2 consist of a finishing block consisting of two separate rolling sub-units 11', 11" containing rolling rolls, the gaps of which can be regulated independently from each other. Furthermore, the rotation speeds of the rolling rolls of the two sub-units can also be autonomously regulated in each sub-unit 11', 11", thus allowing the differentiated regulation of the pulling action on the two strands 1 and 2.

The finishing block 11 serves the main function of rolling the two strands separately and in control of the pulling action with respect to the oval rolling unit 10 preceding it, so as to impose two separate pulling actions and compensate any differences in rolling speed between the two strands 1 and 2, at the expense of the respective section of each strand, which will be slightly different due to an unequal flow of mass. The purpose is to have two strands 1, 2 with equal length, and this corresponds to an equal average rolling speed of the two strands: the control system serves the purpose of making the two average rolling speeds of the strands coincide. As mentioned, this last rolling unit 11 also has the feature of separately regulating the number of revolutions, and possibly the gap, of the two rolling sub-units 11', 11", so as to ensure flexibility in keeping over time of the section of the strands 1 and 2 on the respective lines 100 and 200.

In addition to an increased speed of the strands 1 and 2, the increased number of revolutions of the rolls in the rolling unit 11 also results in a decrease of the rolled section because the material is increasingly pulled and lengthened. Therefore an attempt is made to eliminate the variation in length of the strands generated with a diameter variation thereof.

The diameter of the strands must obviously remain within predetermined tolerance limits. This results in one of the two strands having a slightly larger mass than the other (always within the legal tolerances), but discards and material wastage are eliminated, thus in any event ensuring the length of the finished strand.

This control system provides entering into action only if the following starting conditions are met:

$$-0.5\% < A1 - A2 < 0.5\% \text{ and}$$

$$-0.5\% < V1 - V2 < 0.5\%.$$

This occurs because the differences in section and in speed between the two strands can not be greater than 1% because this could result in a strand being outside the tolerances.

Figure 7:
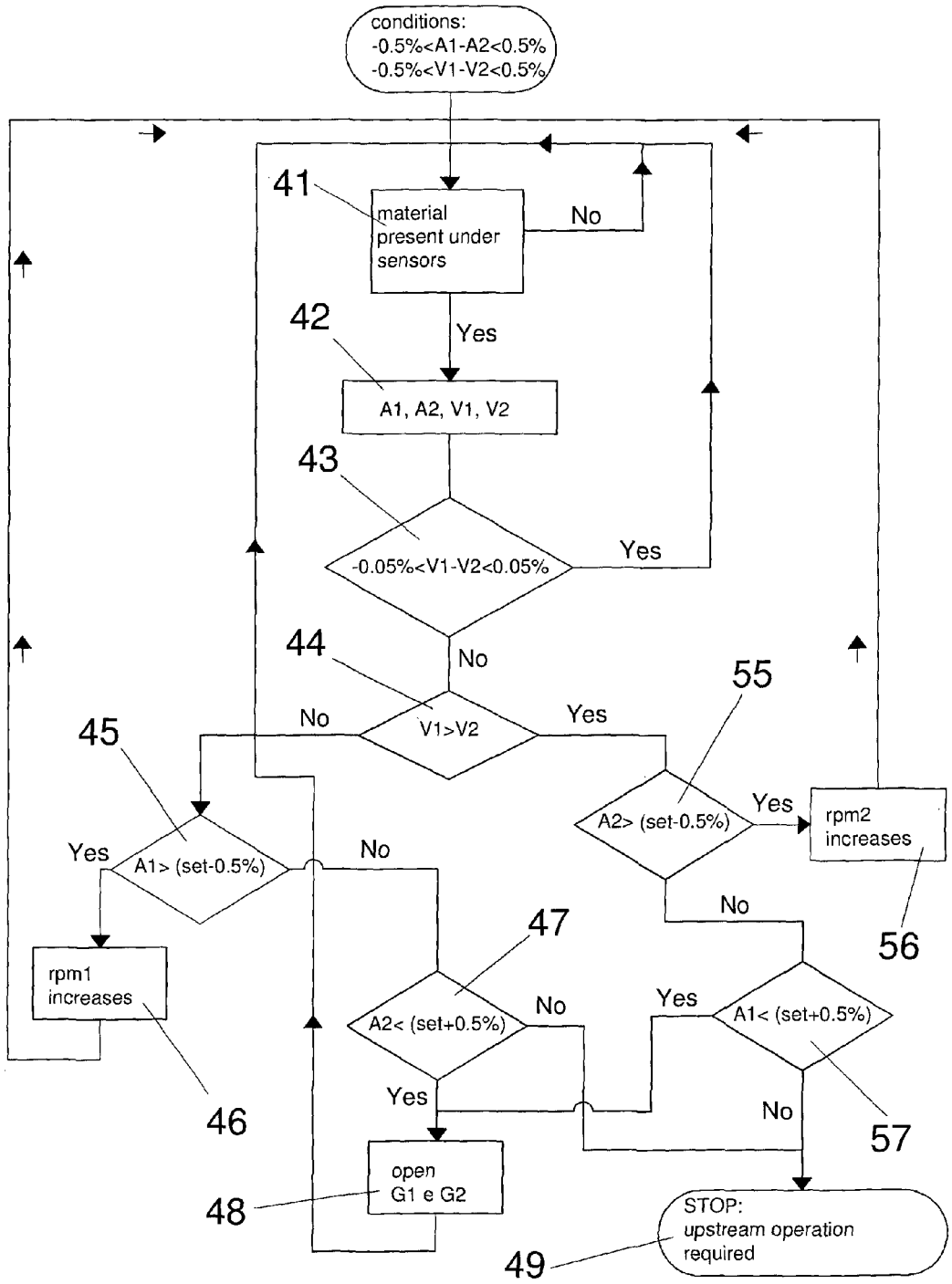
FIG. 7 depicts a flow diagram of a method for controlling the plant in FIG. 4.

Hence, starting with these conditions, the control system, the operation of which is indicated in the flow diagram in FIG. 7, starts verifying the presence of material (block 41) and, if it is there, detects the values of the sections A1, A2 and of the speeds V1, V2 of the strands 1, 2 with the respective sensors (block 42), otherwise the cycle resumes. Alternatively, the values can be continuously detected but only be analysed later in the presence of the material. Once sections A1, A2 and speeds V1, V2 have been detected, the control system verifies if $$-0.05\% < V1 - V2 < +0.05\% \text{ (block 43)}$$

i.e. if the difference in speed between the two strands 1 and 2 of the lines 100 and 200, indicated in FIG. 5, falls within the range accepted by the control system (hence the control system limits the difference in speed to 0.1% so that shear 15 can cut two bars of equal length or at most with an acceptable variation). If the response is affirmative the system resumes from the beginning, instead if the response is negative another check is performed among the speeds of the strands:

$$V1 > V2 \text{(block 44)}$$

i.e. the faster of the two lines 100 or 200 is identified by calculating if the speed of line 100 is greater than the one of line 200. Should the response be affirmative, i.e. if V2<V1, there would be a need to increase the pulling action of the rolling sub-unit 11" on line 200, thus consequently decreasing section A2; but before performing this operation, the system must ensure that section A2 is not already at the lower limit: so it is verified if A2>(Set−0.5%), (block 55), where Set is the nominal size of the section of the finished product or other predefined value. If the response is affirmative, i.e. section A2 falls within the accepted range, then the pulling action of the rolling sub-unit 11" on line 200 is increased (block 56), that is the number of revolutions rpm2 of the rolling rolls of the rolling sub-unit 11" is increased, and the control activity is resumed from the beginning. Instead, if the condition A2>(Set−0.5%) is not met, it means that section A2 is at the tolerance limit and can not be further reduced. The control system then verifies if section A1<(Set+0.5%), i.e. if the section of strand 1 on line 100 is less than the upper limit or if instead it exceeds it (block 57). If the response at block 57 is affirmative, then the control system controls the two motors of the rolling rolls of the rolling sub-units 11', 11" and increases gap G2 of the rolling rolls of sub-unit 11" on line 200 so as to increase section A2 and result in it no longer being precisely at the limit of tolerability, but it also simultaneously increases gap G1 of the rolling rolls of sub-unit 11' on line 100 so as not to further increase the difference in speed of the two lines 100 and 200 (block 48). The gaps G1 and G2 can be increased by the same quantity or gap G1 can be increased a little more than gap G2 so as to increase speed V2. If there is a negative response at block 57, i.e. section A1 is excessively large and section A2 is excessively small, the control system does not perform any action and signals an error upstream (block 49). In this case, there is a need for an operation upstream.

If the response at block 44 is negative, i.e. the speeds are V2>V1, the pulling action of the rolling sub-unit 11' on line 100 should be increased, thus consequently decreasing section A1. But before performing this operation, the control system must ensure that section A1 is not already at the lower limit: so it is verified if section A1>(Set−0.5%), (block 45), where Set is the nominal size of the section of the finished product or other predefined value. If the response is affirmative, i.e. section A1 falls within the accepted range, then the pulling action of the rolling sub-unit 11' on line 100 is increased (block 46), that is the number of revolutions rpm1 of the rolling rolls of the rolling sub-unit 11' is increased, and the control activity is resumed from the beginning. Instead, if A1>(Set−0.5%), it means that section A1 is at the tolerance limit and can not be further reduced. The control system then verifies if section A2<(Set+0.5%), i.e. if the section of strand 2 on line 200 is less than the upper limit or if instead it exceeds it (block 47).

If the response at block 47 is affirmative, then the control system controls the two motors of the rolling rolls of the rolling sub-units 11', 11" and increases gap G1 of the rolling rolls of sub-unit 11' on line 100 so as to increase section A1 and result in it no longer being precisely at the limit of tolerability, but simultaneously also increases gap G2 of the rolling rolls of sub-unit 11" on line 200 so as not to further increase the difference in speed of the two lines (block 48). The gaps G1 and G2 can be increased by the same quantity or gap G2 can be increased a little more than gap G1 so as to increase speed V1. If there is a negative response at block 47, i.e. section A2 is excessively large and section A1 is excessively small, the control system stops and signals an error upstream (block 49). In this case, there is a need for an operation upstream.

The regulations which are performed on the pulling action of the last rolling unit 11 are advantageously proportionate to the entity of the difference between the speeds V1 and V2, but are small in all cases, i.e. at most the pulling action varies by 0.5% (5 rpm over 1000); and the system must ensure that:

a) the punctual values of the speeds V1 and V2 are as similar as possible;

b) the average values of the speeds V1 and V2 are as similar as possible: at the end, the average values of the speeds between one cut and the next will determine the actual lengths of the cut strands.

The two embodiments of the above-described invention in relation to FIGS. 2 and 4 can be combined to form a third one (not shown in the figures), in which the control system performs a feedback both on the rest bar 14 to equilibrate/balance the mass flows of the two lines 100 and 200, and at the level of the last rolling unit 11, which may be separately regulated on the two lines 100 and 200, to obviate the different residual mass flows. This third variant of the invention is also advantageously applied in plants in which a commercial length cut is directly applied in line, immediately outside the rolling mill, with shear 15.

The main advantages of the method of the invention consist in

- being able to decrease the quantity of human resources required for the activity of controlling a two strand slit plant;
- being able to automate the command of the rest bar 14 with feedback control;
- balancing the mass flow at the outlet of the moulder unit 12, in the first embodiment of the above-described method;
- being able to manage the difference of mass flow in the production of bars cut in line at commercial length, in the second embodiment of the above-described method;
- minimizing/eliminating the discards in traditional plants, thus increasing the process performance.

The invention claimed is:

1. A method for controlling a two continuous strands production plant, said two continuous strands being obtained by dividing a single continuous metal billet into two parts along a central longitudinal axis thereof, said production plant being provided with:

- one or more first rolling units for reducing the single billet to a substantially rectangular section,
- a rest bar having an inlet guide mounted thereon,
- a moulder unit for starting a deformation of the single billet so as to produce a rolled section consisting of two equally shaped parts joined along said central longitudinal axis,
- the rest bar being configured to regulate a transversal position of the inlet guide with respect to the moulder unit,
- one or more second rolling units for deforming the rolled section until achieving an almost complete separation of the two equally shaped parts of the rolled section,
- a cutting box for completing the longitudinal separation of the two equally shaped parts of the rolled section and producing two separate strands of the rolled section,
- one or more third rolling units for rolling said two strands, along respective rolling lines, comprising a last rolling unit of said plant consisting of a finishing block comprising two separate rolling sub-units which are regulated independently from each other, and positioned downstream of said first and second rolling units,
- a control system that calculates mass flow of each of said two strands based on measurements from a pair of speed sensors, said pair of speed sensors adapted to detect speed of the two strands for calculating the mass flow of the two strands, and arranged downstream of the cutting box, the pair of speed sensors including a first speed sensor arranged to detect speed of a first of the two strands and a second speed sensor arranged to detect speed of a second of the two strands,
- a cutting shear arranged downstream of said pair of speed sensors and of the last rolling unit, wherein said control method comprising:
- a step of measuring said speed of the two strands by means of the pair of speed sensors,
- step of calculating the mass flow of each of said two strands starting from said speed of the two strands and of calculating the difference of mass flow between said two strands,
- a feedback step on at least one component of said production plant which varies the mass flow along said lines so as to decrease the difference in length between the two strands as a function of said difference of mass flow between said two strands.

2. The method according to claim 1, wherein the at least one component of the production plant is the rest bar and the feedback step provides modifying the position of the rest bar to obtain the centering of the billet in the moulder stand.

3. The method according to claim 2, wherein the feedback step provides a micrometric and automatic regulation of the rest bar.

4. The method according to claim 1, wherein said speed sensors are arranged downstream of the last rolling unit and the parameters for calculating the mass flow of the two strands comprise the rolling speed V1 and V2 of the strands.

5. The method according to claim 1 wherein said plant is further provided with a pair of section surface measurers adapted to detect section surface parameters of the two strands, the section surface measurers and the speed sensors being arranged downstream of the cutting box and before the last rolling unit for a case when there is more than one third rolling unit downstream of the cutting box, and the parameters for calculating the mass flow of the two strands comprise the surface of the sections A1 and A2 and the rolling speeds V1 and V2 of the strands.

6. The method according to claim 1, wherein the at least one component of the production plant comprises the last rolling unit.

7. The method according to claim 6, wherein there is provided modifying the working parameters of the last rolling unit, in particular the number of revolutions of, and/or gap between, the rolling rolls of at least one of the rolling sub-units.

8. The method according to claim 7, wherein said plant is further provided with a pair of section surface measurers adapted to detect section surface parameters of the two strands, the section surface measurers and the speed sensors being arranged downstream of the last rolling unit and upstream of the cutting shear, and the parameters for calculating the mass flow of the two strands comprise the surface measurements of the sections A1 and A2 and the rolling speeds V1 and V2 of the strands.

9. The method according to claim 8, wherein the at least one component of the production plant also comprises the rest bar.

10. The method according to claim 9, wherein said feedback step provides modifying the position of the rest bar to obtain the centering of the billet in the moulder stand.

11. The method according to claim 10, wherein the feedback step provides a micrometric and automatic regulation of the rest bar.

* * * * *